US008801138B2

(12) United States Patent
Torigoe et al.

(10) Patent No.: US 8,801,138 B2
(45) Date of Patent: Aug. 12, 2014

(54) LIQUID EJECTION APPARATUS HAVING FAN FOR COOLING THE LIQUID EJECTING HEAD

(75) Inventors: Yasuhide Torigoe, Matsumoto (JP); Hiroshi Miyazawa, Okaya (JP); Takayuki Iijima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/600,972

(22) Filed: Aug. 31, 2012

(65) Prior Publication Data

US 2013/0057615 A1 Mar. 7, 2013

(30) Foreign Application Priority Data

Sep. 5, 2011 (JP) ..... 2011-193235

(51) Int. Cl.
*B41J 29/377* (2006.01)

(52) U.S. Cl.
CPC ..... *B41J 29/377* (2013.01)
USPC ..... 347/18

(58) Field of Classification Search
CPC ..... B41J 29/377
See application file for complete search history.

(56) References Cited

U.S. PATENT DOCUMENTS

| | | | | |
|---|---|---|---|---|
| 5,406,316 | A | 4/1995 | Schwiebert et al. | |
| 6,281,910 | B1 * | 8/2001 | Nakano et al. | 347/34 |
| 6,390,618 | B1 * | 5/2002 | Wotton et al. | 347/102 |
| 2003/0067507 | A1 * | 4/2003 | Anzai | 347/17 |
| 2010/0245522 | A1 * | 9/2010 | Miyashita et al. | 347/220 |

FOREIGN PATENT DOCUMENTS

| | | | |
|---|---|---|---|
| JP | 04-031076 | | 2/1992 |
| JP | 04351577 | A * | 12/1992 |
| JP | 07-017037 | | 1/1995 |
| JP | 2003220696 | A * | 8/2003 |
| JP | 2005-059478 | | 3/2005 |
| JP | 2006-175645 | | 7/2006 |

OTHER PUBLICATIONS

Machine generated English translation of JP2003-220696A to Ito, "Ink Jet Recording Apparatus," generated via http://www19.ipdl.inpit.go.jp/PA1/cgi-bin/PA1INDEX on Aug. 2, 2013; 9 pp.*

* cited by examiner

*Primary Examiner* — Shelby Fidler
(74) *Attorney, Agent, or Firm* — Workman Nydegger

(57) ABSTRACT

A liquid ejection apparatus includes a liquid ejecting head that ejects a liquid onto a target; a carriage that is moved to scan in a direction perpendicular to a transportation direction of the target with the liquid ejecting head being mounted on the carriage; a fan that blows gas toward a scanning area of the carriage; and a partition member that is positioned so as to separate the scanning area of the carriage from the fan and block the gas blown from the fan toward the scanning area of the carriage.

4 Claims, 3 Drawing Sheets

LIQUID EJECTION APPARATUS HAVING FAN FOR COOLING THE LIQUID EJECTING HEAD

This application claims priority to Japanese Patent Application No. 2011-193235 filed on Sep. 5, 2011. The entire disclosure of Japanese Patent Application No. 2011-193235 is hereby incorporated herein by reference.

BACKGROUND

1. Technical Field

The present invention relates to a liquid ejection apparatus that ejects a liquid onto a target.

2. Related Art

An ink jet printer is known as a type of liquid ejection apparatus that ejects a liquid from a liquid ejecting head onto a recording medium such as a sheet of paper so as to form images on the recording medium. Such an ink jet printer includes that has a cooling unit for cooling the liquid ejecting head, for example, as described in JP-A-4-31076.

The printer described in JP-A-4-31076 includes a reading unit that reads a manuscript and a recording unit that performs recording on a recording target material (recording medium) based on reading signals which are output from the reading unit. The recording unit includes a carriage that is moved to scan in a direction across a transportation direction of the target with a recording head being mounted on the carriage. The recording unit performs recording on the recording target material by ejecting ink from the recording head (liquid ejecting head) onto the recording target material while the carriage is moved for scanning.

Further, a fan for cooling is provided at a position between the reading unit and the recording unit. When the fan operates, outside air is drawn into the printer through an air inlet port which is formed on the outer casing of the printer. In this configuration, the air inlet port is located in proximity to a stand-by position of the recording head. Accordingly, when the fan operates, the air drawn through the air inlet port is blown against the recording head which is positioned at the stand-by position so that the recording head is efficiently cooled.

In the above-mentioned printer, when the air is drawn through the air inlet port, a flow of air is generated in the recording unit. The flow of air may affect the ejection precision of ink ejected from the recording head to the recording target material, which may decrease the quality of image formed on the recording target material by the recording head.

SUMMARY

An advantage of some aspects of the invention is that a liquid ejection apparatus that is capable of preventing the decrease in the ejection precision of a liquid ejected from the recording head, while cooling the liquid ejecting head is provided.

According to an aspect of the invention, a liquid ejection apparatus includes a liquid ejecting head that ejects a liquid onto a target; a carriage that is moved to scan in a direction perpendicular to a transportation direction of the target with the liquid ejecting head being mounted on the carriage; a fan that blows gas toward a scanning area of the carriage; and a partition member that is positioned so as to separate the scanning area of the carriage from the fan and block the gas blown from the fan toward the scanning area of the carriage.

With this configuration, the gas blown from the fan toward the scanning area of the carriage is blown against the partition member so as to cool the partition member. As the partition member is cooled, the atmosphere in the scanning area of the carriage adjacent to the partition member is cooled, resulting in the liquid ejecting head mounted on the carriage being cooled. Moreover, the gas blown from the fan toward the scanning area of the carriage is blocked by the partition member, thereby suppressing generation of a flow of gas in the scanning area of the carriage. Accordingly, the effect on the ejection precision of a liquid ejected from the liquid ejecting head onto the target is suppressed. Therefore, the liquid ejecting head can be cooled while preventing the ejection precision of a liquid ejected from the liquid ejecting head from being decreased.

It is preferable that, in the liquid ejection apparatus according to the invention, the partition member is positioned so as to separate a stand-by position from the fan, the stand-by position being a position in which the carriage is positioned in the scanning area of the carriage when the liquid ejecting head is in a liquid ejection stand-by state, and the fan is configured to blow the gas toward the stand-by position.

With this configuration, the gas blown from the fan cools the partition member in proximity to the stand-by position of the carriage. Accordingly, the fan can cool the liquid ejecting head mounted on the carriage in an efficient manner via the partition member during the liquid ejection stand-by state.

It is preferable that, in the liquid ejection apparatus according to the invention, the partition member has a cooling fin that is positioned on a flow path of the gas blown from the fan.

With this configuration, the partition member increases the area which is in contact with the gas blown from the fan by providing the cooling fin. Accordingly, the fan can cool the partition member in a more efficient manner.

It is preferable that, in the liquid ejection apparatus according to the invention, the cooling fin is formed by cutting and bending up from the partition member which is plate-shaped.

With this configuration, it is possible to provide the cooling fin of the partition member in a convenient manner without adding a new component configuration.

It is preferable that, in the liquid ejection apparatus according to the invention, the cooling fin is formed by cutting and bending up toward the outside of the scanning area so as to form a projection at least on the edge of the opening on the side of the fan of the edges of the opening formed by cutting and bending up from the partition member.

When the cooling fin is formed by cutting and bending up from the partition member which is in plate-shaped, since an opening is formed on the partition member, it may be possible that the gas blown from the fan flows into the scanning area of the carriage through the opening of the partition member. With the above-mentioned configuration, the cooling fin is cut and bent up on the edge of the edges of the opening of the partition member which is located on the side of the fan so as to form a projection that extends toward the outside of the scanning area. Accordingly, when the gas blown from the fan reaches the edge of the edges of the opening of the partition member which is located on the side of the fan, the gas is directed to flow along the cooling fin in the direction away from the opening. As a result, flow of the gas from the fan into the scanning area of the carriage via the opening of the partition member is suppressed. Accordingly, the partition member prevents the gas blown from the fan from flowing into the scanning area of the carriage, thereby suppressing the effect on the ejection precision of the liquid ejected from the liquid ejecting head onto the target.

It is preferable that, in the liquid ejection apparatus according to the invention, a carriage motor that transmits a drive power to the carriage when the carriage performs scanning is positioned on a flow path of the gas blown from the fan.

With this configuration, the carriage motor is positioned on a flow path of the gas blown from the fan toward the scanning area of the carriage. Accordingly, the gas blown from the fan toward the scanning area of the carriage can cool the carriage and the liquid ejecting head as well as the carriage motor.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1A:
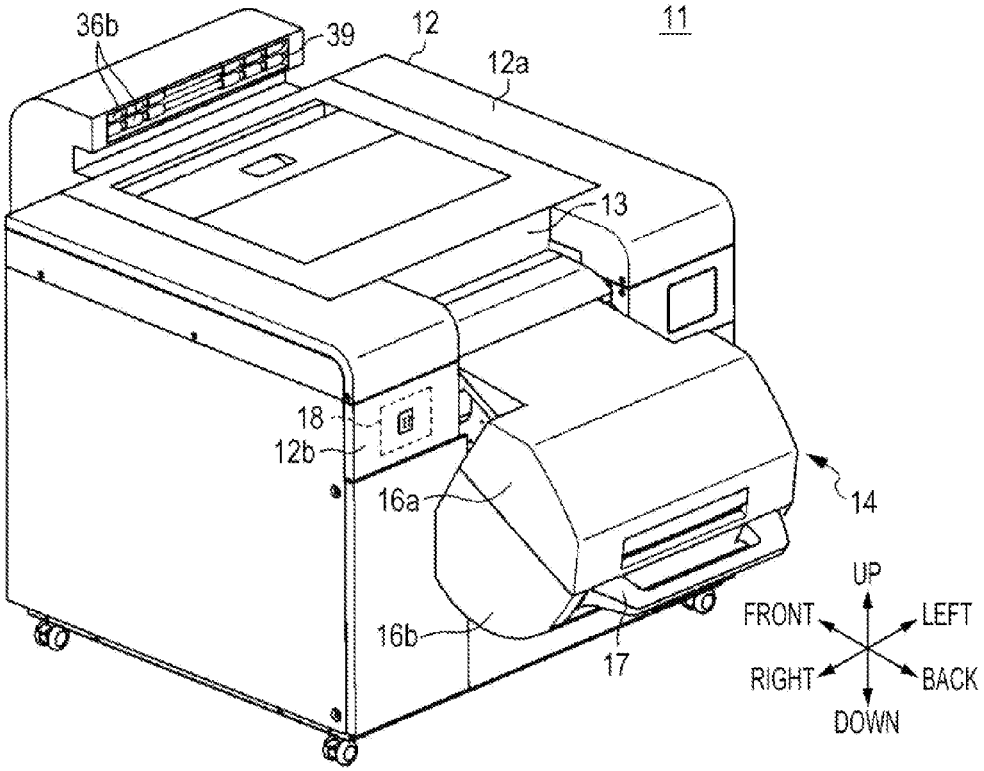
FIG. 1A is a perspective view of a printer according to an embodiment of the invention.

The invention will be described below with reference to FIGS. 1A to 4, which show an ink jet printer as a type of liquid ejection apparatus according to an embodiment of the invention. As shown in FIG. 1A, an apparatus body 12 is a housing of a printer 11 which is a liquid ejection apparatus. The apparatus body 12 has a top side 12*a* which is formed as a substantially rectangular-shaped plane lying in the horizontal direction. A recess 13 is formed at the substantial center of the edge which extends in the left-right direction between the top side 12*a* and a rear side 12*b* of the apparatus body 12. The recess 13 is formed as a notch that opens with respect to both the top side 12*a* and the rear side 12*b*.

Figure 1B:
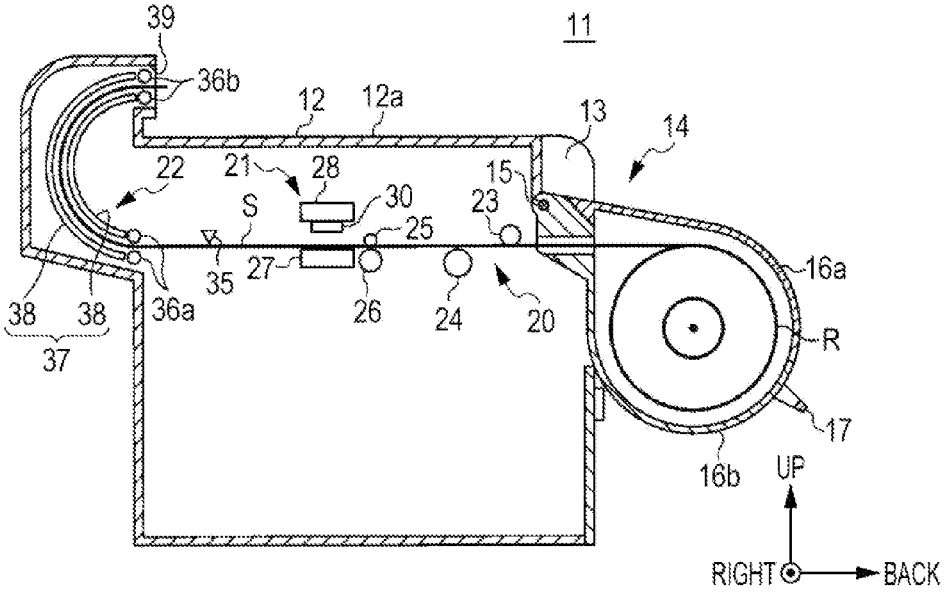
FIG. 1B is a side sectional view of the printer according to the embodiment of the invention.

A roll body container 14 is attached to the rear side 12*b* of the apparatus body 12 in a rotatable manner via a rotation shaft 15 (see FIG. 1B) at a position corresponding to the recess 13 in the left-right direction. The roll body container 14 is composed of an upper case portion 16*a* having a box shape which opens downward and a lower case portion 16*b* having a box shape which opens upward. The case portions 16*a* and 16*b* abut together as shown in FIG. 1B, thereby forming a housing space inside the roll body container 14 for housing a roll body R which is formed by winding a sheet S which is a target in a long strip shape into a roll. A handle 17 substantially in a U-shape is formed on and extends backward from the rear end of the lower case portion 16*b*. Further, as shown in FIG. 1A, a cooling fan 18 is disposed at the upper right position of the rear side 12*b* of the apparatus body 12 so as to cool various members in the apparatus body 12 with air (gas) drawn from the outside of the apparatus body 12.

As shown in FIG. 1B, a transportation section 20, a printing section 21, and a paper output section 22 are provided in the apparatus body 12. The transportation section 20 includes a plurality of transportation rollers 23 to 26 which are disposed along the transportation path of the sheet S. As the sheet S is unwound and fed from the roll body R in the roll body container 14, the transportation rollers 23 to 26 transport the sheet S toward the printing section 21.

In the printing section 21, a support plate 27 having a support surface (in FIG. 1B, the top side of the support plate 27) is disposed so as to support the sheet S when the sheet S unwound from the roll body R is transported. Further, a carriage 28 is movably supported by a guide shaft which extends in the left-right direction, which is not shown in the figure, at a position corresponding to the support surface of the support plate 27 in the up-down direction. The carriage 28 is configured to scan in the width direction (the left-right direction in FIGS. 1A and 1B) which is across the transportation direction of the sheet S when driven by a carriage motor 29 (see FIG. 2). A recording head 30 as a liquid ejecting head is supported on the underside of the carriage 28. Further, a plurality of nozzles (not shown in the figure) through which ink is ejected is also formed on the underside of the carriage 28. The recording head 30 performs printing operation by ejecting ink onto the sheet S when the sheet S is transported between the recording head 30 and the support plate 27.

A home position HP (see FIG. 3) is provided in the printing section 21 on the right side relative to the support plate 27 (in front of the plane of the drawing of FIG. 1B), that is, a non-printing area where the sheet S does not reach. The home position HP serves as a stand-by position in which the carriage 28 is positioned while ink ejection is suspended for maintenance of the recording head 30. A maintenance unit, which is not shown, that executes various maintenance operations (for example, cleaning) is disposed below the home position HP in order to maintain satisfactory ejection of ink ejected from the recording head 30 onto the sheet S.

A cutter 35 that is configured to cut the sheet S in the width direction (left-right direction) which is across the transportation direction is also disposed in the printing section 21 at a position downstream of the support plate 27 on the transportation path of the sheet S. The sheet S in the form of a continuous sheet is cut with the cutter 35 into separate cut sheets.

The paper output section 22 includes pairs of transportation rollers 36*a*, 36*b* that apply a transportation force to the sheet S in the form of cut sheet, which has been cut with the cutter 35 in the printing section 21, so as to feed the sheet S downstream in the transportation direction. The paper output section 22 further includes a reversing section 37 in which the sheet S to which the transportation force has been applied by the pair of transportation rollers 36*a*, 36*b* is flipped over. The reversing section 37 is composed of two guide plates 38, each of which has a substantially arc shape in cross section. The guide plates 38 are disposed parallel to and spaced apart from each other in the front-back direction such that a curved reversing path is formed between the guide plates 38. The pair of transportation rollers 36*a* is disposed at a position in proximity to an upstream end of the reversing path in the reversing section 37, while the pair of transportation rollers 36*b* is disposed at a position in proximity to a downstream end of the reversing path in the reversing section 37. The upper end of the reversing section 37 is located above the top side 12*a* of the apparatus body 12.

After printing operation is performed on the sheet S by the recording head 30, the sheet S is transported downstream and flipped over as the sheet S passes through the reversing path in the reversing section 37. The sheet S which has been flipped over is output from an output port 39 which is provided on the front side of the apparatus body 12 and above the top side 12*a* toward the back side of the apparatus body 12 where the roll body container 14 is attached. When output from the output port 39, the sheet S is placed on the top side 12*a* of the apparatus body 12 with the printing surface on which ink is applied facing down.

Figure 2:
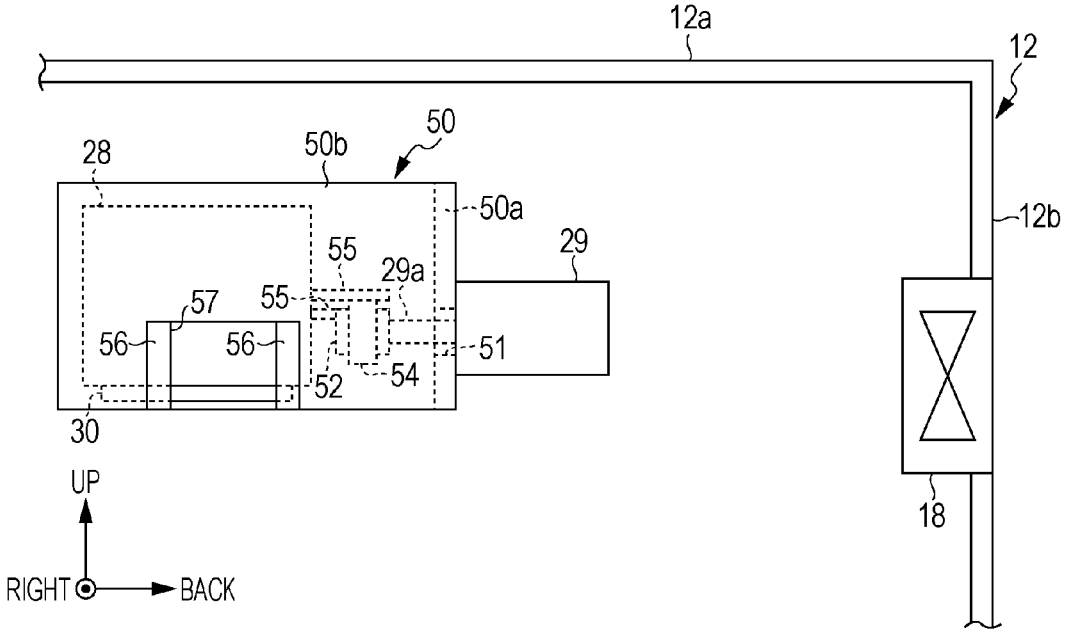
FIG. 2 is a side view which schematically shows a configuration around a carriage.
Figure 3:
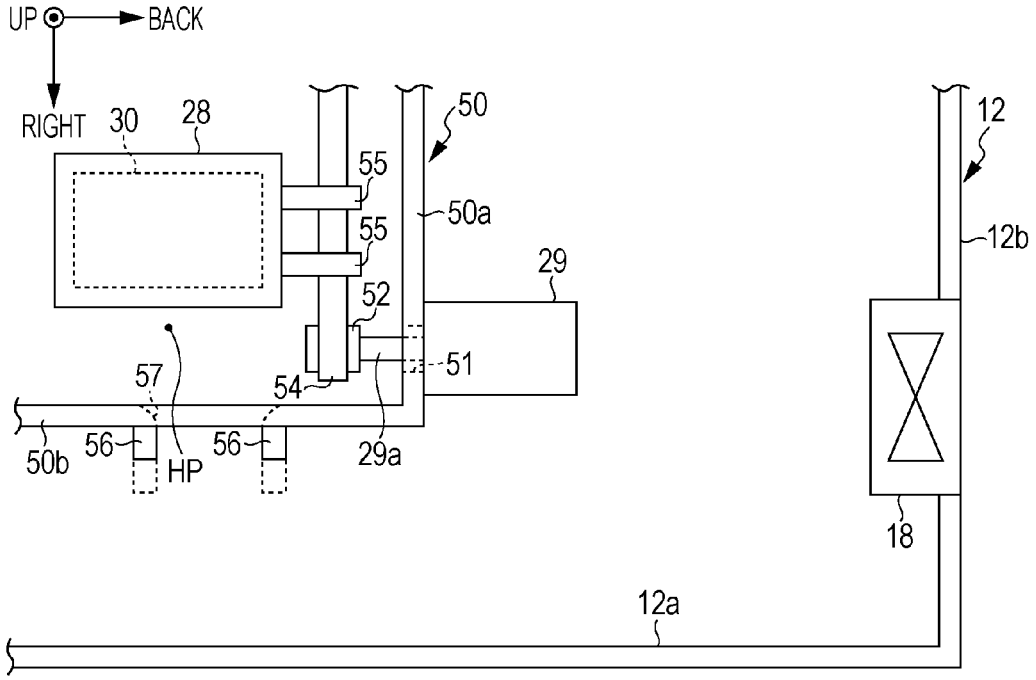
FIG. 3 is a plan view which schematically shows a configuration around the carriage.

Next, a configuration around the carriage 28 will be described below. As shown in FIGS. 2 and 3, a carriage frame 50 made of a metal material having high thermal conductance is disposed in the apparatus body 12 so as to surround the scanning area of the carriage 28. The carriage frame 50 includes a rear wall 50*a* that extends in the scan direction of the carriage 28 and in a direction perpendicular to an air flow direction from the cooling fan 18 and a right wall 50*b* that extends in the front direction from the right end of the rear wall 50*a* which is a position opposite the cooling fan 18 in the air flow direction. The corner between the rear wall 50*a* and the right wall 50*b* of the carriage frame 50 is located in the air flow path of the air drawn from the cooling fan 18 which is disposed on the rear side 12*b* of the apparatus body 12 into the apparatus body 12 so that the carriage frame 50 serves as a partition member that separates the scanning area of the carriage 28 from the cooling fan 18.

The carriage motor 29 is fixedly attached on the back side of the rear wall 50*a* of the carriage frame 50 at a position close to the right end of the rear wall 50*a*. That is, the carriage motor 29 is located in proximity to the home position HP of the carriage 28. The carriage motor 29 is positioned at substantially the same height as the cooling fan 18 such that the carriage motor 29 opposes the cooling fan 18 in the front-back direction, which is the air flow direction from the cooling fan 18.

The distal end of a drive shaft 29*a* of the carriage motor 29 extends into the scanning area of the carriage 28 through a through hole 51 that penetrates the rear wall 50*a* of the carriage frame 50 in the front-back direction. Further, the distal end of the drive shaft 29*a* of the carriage motor 29 is connected to a driving pulley 52. Accordingly, the driving pulley 52 is located in the scanning area of the carriage 28.

Further, a driven pulley, which is not shown, is rotatably provided at the end (left end) of the rear wall 50*a* of the carriage frame 50 on the opposite side of the driving pulley 52 in the left right direction, which is the scan direction of the carriage 28. An endless belt 54 is stretched around the driving pulley 52 and the driven pulley. Two pairs of upper and lower engaging members 55 are provided at positions on the back side of the carriage 28 with a space therebetween in the left-right direction. Each of the pair extends backward so as to hold the belt 54 in the upper and lower positions. Accordingly, the carriage 28 is connected to the carriage motor 29 so as to be capable of transmitting a drive power via the belt 54.

A pair of front and rear rectangular-shaped projection pieces is cut and bent up from the right wall 50*b* of the carriage frame 50, thereby forming a rectangular-shaped opening 57 on the right wall 50*b* through which the inside and outside of the scanning area of the carriage 28 communicate. A rear projection piece 56 of a pair of front and rear projection pieces 56 which is located on the side of the cooling fan 18 is cut and bent up on the rear edge of the opening 57 so as to form a projection that extends toward the outside of the scanning area of the carriage 28, while a front projection piece 56 is cut and bent up on the front edge of the opening 57 so as to form a projection that extends toward the outside of the scanning area of the carriage 28. In addition, as indicated by the two-dot chain line in FIG. 3, after each projection piece 56 is cut and bent up from the right wall 50*b* of the carriage frame 50, a specified length is cut off at the distal end of each projection piece 56 so as to form a short projection piece for space efficiency.

As shown in FIG. 2, each projection piece 56 extends from the lower end of the right wall 50*b* of the carriage frame 50 to the substantially center in the height direction of the right wall 50*b* of the carriage frame 50. The projection piece 56 horizontally extends in the apparatus body 12 toward the area separated by the carriage frame 50 from the scanning area of the carriage 28 and located on the side of the cooling fan 18 such that the projection piece 56 extends in a direction perpendicular to the air flow direction from the cooling fan 18. Further, the projection piece 56 is positioned at substantially the same height as the cooling fan 18 such that the projection piece 56 opposes the cooling fan 18 in the front-back direction, which is the air flow direction from the cooling fan 18.

Next, operations of the printer 11 with the above-mentioned configuration will be described below, specifically focusing on the operation in which the cooling fan 18 cools the carriage 28. When the cooling fan 18 is actuated, air is drawn from the outside into the apparatus body 12. The air which is drawn into the apparatus body 12 is then blown toward the area in proximity to the home position HP in the carriage frame 50. The air from the cooling fan 18 promotes heat dissipation of the carriage frame 50 and allows the carriage frame 50 to be cooled to a temperature lower than the atmosphere of the home position HP of the carriage 28. As a consequence, heat dissipation from the carriage 28 which is positioned in the home position HP in a stand-by state to the carriage frame 50 is promoted via the atmosphere of the home position HP so that the carriage 28 is indirectly cooled.

Since the carriage frame 50 is positioned at a position on a line connecting the cooling fan 18 and the scanning area of the carriage 28 in the air flow direction from the cooling fan 18, the carriage frame 50 separates the area on the side of the cooling fan 18 from the scanning area of the carriage 28. That is, the carriage frame 50 prevents the air from the cooling fan 18 from flowing into the scanning area of the carriage 28. As a result, the air from the cooling fan 18 mostly does not cause a flow of air in the scanning area of the carriage 28, and accordingly, mostly does not affect the ejection direction of ink ejected from the recording head 30 onto the sheet S while the carriage 28 is moved to scan the scanning area.

Moreover, the projection pieces 56 of the carriage frame 50 promote heat dissipation by increasing the area which is in contact with the air blown from the cooling fan 18, thereby serving as a cooling fin that increase cooling efficiency of the carriage frame 50 by the cooling fan 18. As a result, the area in proximity to the home position HP in which the projection pieces 56 are formed on the carriage frame 50 is efficiently cooled with the cooling fan 18. Accordingly, the carriage 28 which is positioned in the home position HP in the stand-by state is sufficiently cooled with the air from the cooling fan 18 in an indirect manner via the carriage frame 50.

Figure 4:
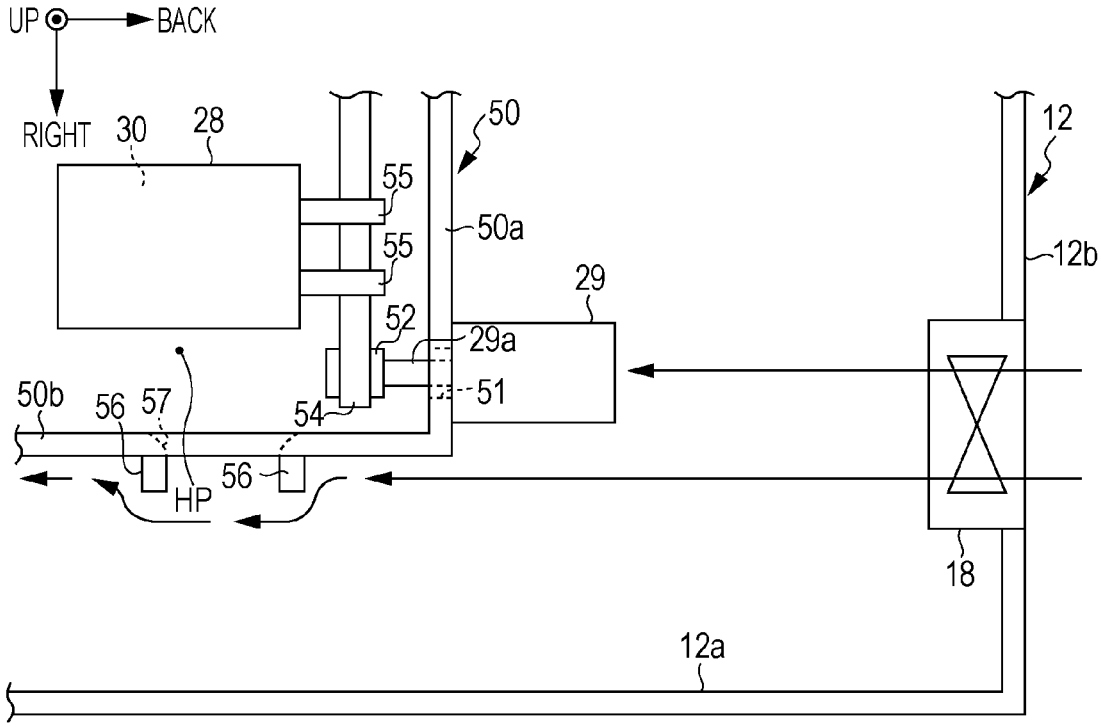
FIG. 4 is a plan view which shows a flow of air from a cooling fan around the carriage.

Since the projection pieces 56 of the carriage frame 50 extend toward the area separated by the carriage frame 50 and located on the side of the cooling fan 18, the air blown from the cooling fan 18 toward the projection pieces 56 is directed to flow in a meandering manner in the proximity of opening 57 of the carriage frame 50 in a direction away from the opening 57, as shown in FIG. 4. Accordingly, the air blown from the cooling fan 18 becomes unlikely to flow into the scanning area of the carriage 28 through the opening 57 of the carriage frame 50. As a result, the air blown from the cooling fan 18 mostly does not cause a flow of air in the scanning area of the carriage 28, thereby suppressing the effect on the ejection direction of ink ejected from the recording head 30 onto the sheet S while the carriage 28 is moved to scan the scanning area.

Further, since the carriage motor 29 is positioned so as to oppose the cooling fan 18 in the front-back direction, which is the air flow direction from the cooling fan 18, the air from the cooling fan 18 is directly blown against the carriage motor 29.

Accordingly, the air from the cooling fan 18 promotes heat dissipation and cooling of the carriage motor 29.

According to the above-mentioned embodiment, the following effect can be obtained:

(1) The air blown from the cooling fan 18 toward the scanning area of the carriage 28 is blown against the carriage frame 50 so as to cool the carriage frame 50. As the carriage frame 50 is cooled, the atmosphere in the scanning area of the carriage 28 adjacent to the carriage frame 50 is cooled, resulting in the recording head 30 mounted on the carriage 28 being cooled. Moreover, the air blown from the cooling fan 18 toward the scanning area of the carriage 28 is blocked by the carriage frame 50, thereby suppressing generation of a flow of air in the scanning area of the carriage 28. Accordingly, the effect on the ejection precision of ink ejected from the recording head 30 onto the sheet S is suppressed. Therefore, the recording head 30 can be cooled while preventing the ejection precision of ink ejected from the recording head 30 from being decreased.

(2) The carriage motor 29 is positioned on a flow path of the air blown from the cooling fan 18 toward the scanning area of the carriage 28. Accordingly, the air blown from the cooling fan 18 toward the scanning area of the carriage 28 can cool the carriage 28 and the recording head 30 as well as the carriage motor 29.

(3) The air blown from cooling fan 18 cools the area in proximity to the home position HP of the carriage 28 in the carriage frame 50. Accordingly, the cooling fan 18 can cool the recording head 30 mounted on the carriage 28 in an efficient manner via the carriage frame 50 during a printing stand-by state in which ink ejection is suspended.

(4) The carriage frame 50 increases the area which is in contact with the air blown from the cooling fan 18 by providing the projection piece 56. Accordingly, the cooling fan 18 can cool the carriage frame 50 in a more efficient manner.

(5) Since the projection piece 56 which serves as a cooling fin is formed by cutting and bending up from the right wall 50*b* of the carriage frame 50, it is possible to provide the cooling fin of the carriage frame 50 in a convenient manner without adding a new component configuration.

(6) The rear projection piece 56 which is located on the side of the cooling fan 18 is cut and bent up on the edge of the edges of the opening 57 of the carriage frame 50 which is located on the side of the cooling fan 18 so as to form a projection that extends toward the outside of the scanning area of the carriage 28. When the air blown from the cooling fan 18 reaches the edge of the edges of the opening 57 of the carriage frame 50 which is located on the side of the cooling fan 18, the air is directed to flow along the projection piece 56 in the direction away from the opening 57. As a result, flow of the air from the cooling fan 18 into the scanning area of the carriage 28 via the opening 57 of the carriage frame 50 is suppressed. Accordingly, the carriage frame 50 prevents the air blown from the cooling fan 18 from flowing into the scanning area of the carriage 28, thereby suppressing the effect on the ejection precision of ink ejected from the recording head 30 onto the sheet S.

The following modifications may be made to the above-mentioned embodiment:

In the above-mentioned embodiment, the projection piece 56 may be formed by cutting and bending up from the right wall 50*b* of the carriage frame 50 toward the inside of the scanning area of the carriage 28.

In the above-mentioned embodiment, the projection piece 56 may be configured to extend over a long length in the front-back direction, which is the air flow direction from the cooling fan 18.

In the above-mentioned embodiment, the projection piece 56 may be formed by bonding to the carriage frame 50, such as by welding. In this case, the carriage frame 50 may be formed without providing the opening 57.

In the above-mentioned embodiment, the cooling fan 18 may blow air against the carriage frame 50 on the area opposite to the home position HP in the scan direction of the carriage 28.

In the above-mentioned embodiment, the carriage motor 29 may be positioned on a flow path of the air blown from the cooling fan 18 toward the outside of the scanning area of the carriage 28.

In the above-mentioned embodiment, the carriage motor 29 may be positioned out of a flow path of the air blown from the cooling fan 18.

In the above-mentioned embodiment, the target is not limited to a roll of wound target in a long strip shape, and a target in the form of cut sheet may be used.

Although the liquid ejecting apparatus is embodied as an ink jet printer 11 in the above embodiment, liquid ejecting apparatuses that eject or dispense liquid other than ink may be used. The invention may be applied to various liquid ejecting apparatuses having a liquid ejecting head or the like that ejects fine liquid droplets. It is noted that the liquid droplets means a state of liquid that is ejected from the liquid ejecting apparatuses and are intended to include those in a particle, tear drop or string shape. Further, the liquid as described herein may be any material that can be ejected from liquid ejecting apparatuses. For example, it may include a material in liquid phase such as liquid having high or low viscosity, sol, gel water, other inorganic solvent, organic solvent and liquid solution, and a material in melted state such as liquid resin and liquid metal (molten metal). Further, in addition to a material in a liquid state, it may include particles of functional material made of solid substance such as pigment and metal particles, which is dissolved, dispersed or mixed in a solvent. Further, typical examples of liquid include ink as mentioned above, liquid crystal and the like. The ink as described herein includes various liquid components such as general water-based ink, oil-based ink, gel ink and hot melt ink. Specific examples of liquid ejecting apparatus may include, for example, liquid ejecting apparatuses that eject liquid containing materials such as electrode material and color material in a dispersed or dissolved state, which are used for manufacturing of liquid crystal displays, EL (electroluminescence) displays, surface emitting displays or color filters, liquid ejecting apparatuses that eject bioorganic materials used for manufacturing biochips, liquid ejecting apparatuses that are used as a precision pipette and eject liquid of a sample, textile printing apparatuses and micro dispensers. Further, examples of fluid ejecting apparatus may also include liquid ejecting apparatuses that eject lubricant to precision instrument such as a clock or camera in a pinpoint manner, liquid ejecting apparatuses that eject transparent resin liquid such as ultraviolet cured resin onto a substrate for manufacturing of minute hemispheric lenses (optical lenses) used for optical communication elements or the like, and liquid ejecting apparatuses that eject acid or alkali etching liquid for etching a substrate or the like. The invention may be applied to any one of the above-mentioned liquid ejecting apparatuses.

What is claimed is:

1. A liquid ejection apparatus comprising:

a liquid ejecting head that ejects a liquid onto a target;

a carriage that is moved to scan in a direction perpendicular to a transportation direction of the target with the liquid ejecting head being mounted on the carriage;

a fan that blows gas toward a scanning area of the carriage; and a partition member that is disposed so as to separate the scanning area of the carriage from the fan and block the gas blown from the fan toward the scanning area of the carriage, wherein the partition member has a cooling fin that is positioned on a flow path of the gas blown from the fan and wherein the cooling fin is formed by cutting and bending up from the partition member which is plate-shaped.

2. The liquid ejection apparatus according to claim 1, wherein the partition member is positioned so as to separate a stand-by position from the fan, the stand-by position being a position in which the carriage is positioned in the scanning area of the carriage when the liquid ejecting head is in a liquid ejection stand-by state, and the fan is configured to blow the gas toward the stand-by position.

3. The liquid ejection apparatus according to claim 1, wherein the cooling fin is formed by cutting and bending up toward the outside of the scanning area so as to form a projection at least on the edge of an opening on the side of the fan of the edges of the opening formed by cutting and bending up from the partition member.

4. The liquid ejection apparatus according to claim 1, wherein a carriage motor that transmits a drive power to the carriage when the carriage performs scanning is positioned on a flow path of the gas blown from the fan.

* * * * *